United States Patent [19]

Kandpal

[11] 4,221,326

[45] Sep. 9, 1980

[54] CALCULATOR FOR COMPARATIVE PRODUCT INVESTMENT RECOVERY

[75] Inventor: Tara C. Kandpal, Tecumseh, Mich.

[73] Assignee: Tecumseh Products Company, Tecumseh, Mich.

[21] Appl. No.: 716,251

[22] Filed: Aug. 20, 1976

[51] Int. Cl.[2] ..... G06G 1/00; G06C 3/00

[52] U.S. Cl. ..... 235/78 F; 235/88 F

[58] Field of Search ..... 235/88, 78, 70 A, 70 R, 235/84

[56] References Cited

U.S. PATENT DOCUMENTS

| | | | |
|---|---|---|---|
| 2,328,881 | 9/1943 | Saunders | 235/78 |
| 2,682,372 | 6/1954 | Romani | 235/88 |
| 3,108,746 | 10/1963 | Chrisler | 235/88 |
| 3,635,398 | 1/1972 | Toni | 235/88 |
| 3,643,859 | 2/1972 | Kreisel, Jr. | 235/88 |
| 3,698,630 | 10/1972 | Dick | 235/78 |
| 3,784,797 | 1/1974 | Kroll | 235/88 |

*Primary Examiner*—L. T. Hix
*Assistant Examiner*—Benjamin R. Fuller
*Attorney, Agent, or Firm*—Albert L. Jeffers

[57] ABSTRACT

A calculator having six discs concentrically mounted for relative rotation having scales and indices which are graduated and are selectively registrable. The calculator is operable to determine the period, in years, to recover the higher price of a higher efficiency air conditioner over a standard air conditioner taking into consideration the differences in price and efficiency; the energy saved; the climate region in which the air conditioner is to be used; the electric rate in the region in which the air conditioner is to be used; the capacity of the air conditioner; and the available interest rate. The calculator will indicate the number of years over which the air conditioner must be used in order to recover the initial price differential of the higher efficiency unit.

3 Claims, 8 Drawing Figures

CALCULATOR FOR COMPARATIVE PRODUCT INVESTMENT RECOVERY

BACKGROUND OF THE INVENTION

1. Field of the Invention

This invention is in the field of calculators which accept a number of parameters, and compare the parameters in a given manner to obtain a given result. More particularly, this invention pertains to a hand calculator having manually rotatable discs, each of which carries a plurality of scales and indices which are selectively registrable.

2. Brief Statement of the Prior Art

Numerous calculators are available in the art which are operable by selective manual registration of relatively slidable or rotatable scales and indices. These vary all the way from the simple general function multiplication slide rule to rather complex multiple scale calulators. Further, special purpose calculators have been provided to determine the relative economy between appliances using gas and eletricity; the radiating area required for various heating systems; and humidity calculations relative to certain air conditioning factors. However, no known calculator is available for determining the advisability of paying a higher price for a higher efficiency product such as an air conditioner given a wide variety of variables to be considered in the calculation.

BRIEF SUMMARY OF THE INVENTION

A calculator having six relatively rotatable concentrically mounted discs is provided with thirteen scales graduated and calibrated with predetermined units, and is provided with five indices, with the scales and indices being manually selectively registrable in a predetermined sequence. The sixth, or uppermost, disc carries a graph having a plurality of non-linear curves representing financing interest rates which are utilized in the calculation. The scales are calibrated in units corresponding to the efficiency of a standard product, such as an air conditioner; the efficiency of a more expensive, more efficient product; the power saved per unit of capacity of one product over the other; the total power saved for a given capacity product over another; the climate regions in which the product is to be used; the electric rate in the region where the product is to be used; the total dollars per year saved in operating costs; the product capacity; and the price differential of the more efficient product over the standard products. The first, and lowermost disc in the calculator, carries the scales graduated in units relating to the efficiency of the higher efficiency product; the power saved per unit of capacity of one product over the other; the total power saved of one product over the other; and the dollars per year in saving of one product over the other. The first disc also carries an index for indicating investment recovery factor. A second disc, mounted immediately above the first disc, has a scale graduated in units of efficiency of a standard product; and an index indicating power saved per unit of capacity of the more efficient product over the lesser efficient product. The third disc, which is mounted for rotation immediately above the second disc, has a scale graduated in units of climatic regions in which the product is to be used and an index for indicating power saved by operation of the more efficient product as compared with the lesser efficient product. A fourth disc is mounted for rotation immediately above the third disc and carries a scale graduated in units of electrical rates for the particular region in which the product is to be used and an index for indicating the climatic region in which the product is to be used. A fifth disc is mounted for rotation immediately above the fourth disc and carries a scale graduated in units of product capacity and an index for indicating the electrical rate for the particular region in which the product is to be used. A sixth disc is mounted for rotation immediately above the fifth disc and carries a scale graduated in units indicating the additional expenditure required to purchase the more efficient unit over the standard unit; a scale indicating the investment recovery factor; and a scale graduated in units of the period over which the product must be used to recover the additional expenditure required by purchase of the more efficient unit over the standard unit. The sixth disc also carries a graph having a plurality of non-linear curves each indicating a different financing interest rate, the particular curve being selected which corresponds to the available rate for the region in which the product is purchased and which is used to convert the investment recovery factor to the investment recovery period. The scales and indices are arranged on the discs, and the discs are configured and provided with windows, so that the necessary alignment between scales and between a scale and an index is possible. The climate region may be determined by a map provided on the reverse side of the first disc segregating regions of comparable climate.

In the operation of the calculator which is specifically designed and calibrated for air conditioners, with the air conditioner capacity being calibrated in "tons" and the power being calibrated in watts, the efficiency rating of a standard air conditioner is aligned with the efficiency rating of the higher efficiency air conditioner on scales in the first and second disc. The watts saved per ton by using the higher efficiency air conditioner can then be read on a scale on the first disc opposite the index on the second disc. The index on the third disc indicating watts saved is then aligned with the scale graduation on the first disc which has been previously indicated opposite the watts saved per ton index. The climate region index on the fourth disc is then aligned opposite the climate region scale on the third disc. The electric rate index on the fifth disc is then aligned with the electric rate scale graduation on the fourth disc which coresponds to the electric rate for the region of use. The dollar saving per year in electricity may then be read on the scale on the first disc opposite the air conditioner capacity scale graduation on the fifth disc. Next, the scale graduation corresponding to the additional expenditure for the higher efficiency air conditioner on the sixth disc is aligned with the air conditioner capacity in tons on the fifth disc. The investment recovery factor may be read at the scale graduation on the sixth disc opposite the investment recovery factor index on the first disc. The indicated investment recovery factor may then be applied to one of a set of coordinates on the graph of the sixth disc and by utilizing the curve for the appropriate financing interest rate in the region of purchase, the investment recovery period, which is the number of years the air conditioner must be used to recover the additional expenditure for the higher efficiency unit, may be read on the other of the set of coordinates on the graph shown on the sixth disc.

Thus, it is possible to quickly and accurately obtain information which will advise a prospective purchaser of an air conditioner whether or not, according to a wide range of pertinent variables and parameters, to purchase a higher efficiency air conditioner. If the number of years in which the air conditioner must be used in order to recover the initial expenditure is excessive, the purchaser is advised of this fact before purchase. Very few purchasers and sales persons of air conditioners have the mathematical capability to determine this calculation and, even if possessing such capability, do not ordinarily have the inclination or the time to go through all the necessary complicated individual calculations to obtain the desired answer. With the calculator of this invention, the many and varied calculations are easily accomplished in a relatively short period of time by a person having little or no mathematical acumen.

It is therefore an object of this invention to provide a calculator for computing relatively quickly and easily the advisability of purchase of a higher efficiency product over a standard product.

It is another object of this invention to provide in the calculator of the previous object a number of concentric, relatively rotatable discs, having a plurality of scales graduated in predetermined units and having indices positioned on the discs with the scales and indices registrable with one another in a predetermined sequence to take into consideration numerous costs, capacities, financing, climatic conditions, efficiency ratios, and financing costs, to obtain in a minimum sequence operation the investment period required to recover the initial additional investment expenditure.

The above-mentioned and other features and objects of this invention and the manner of attaining them will become more apparent and the invention itself will be best understood by reference to the following description of an embodiment of the invention taken in conjunction with the accompanying drawings.

DESCRIPTION OF THE PREFERRED EMBODIMENT

Figure 3:
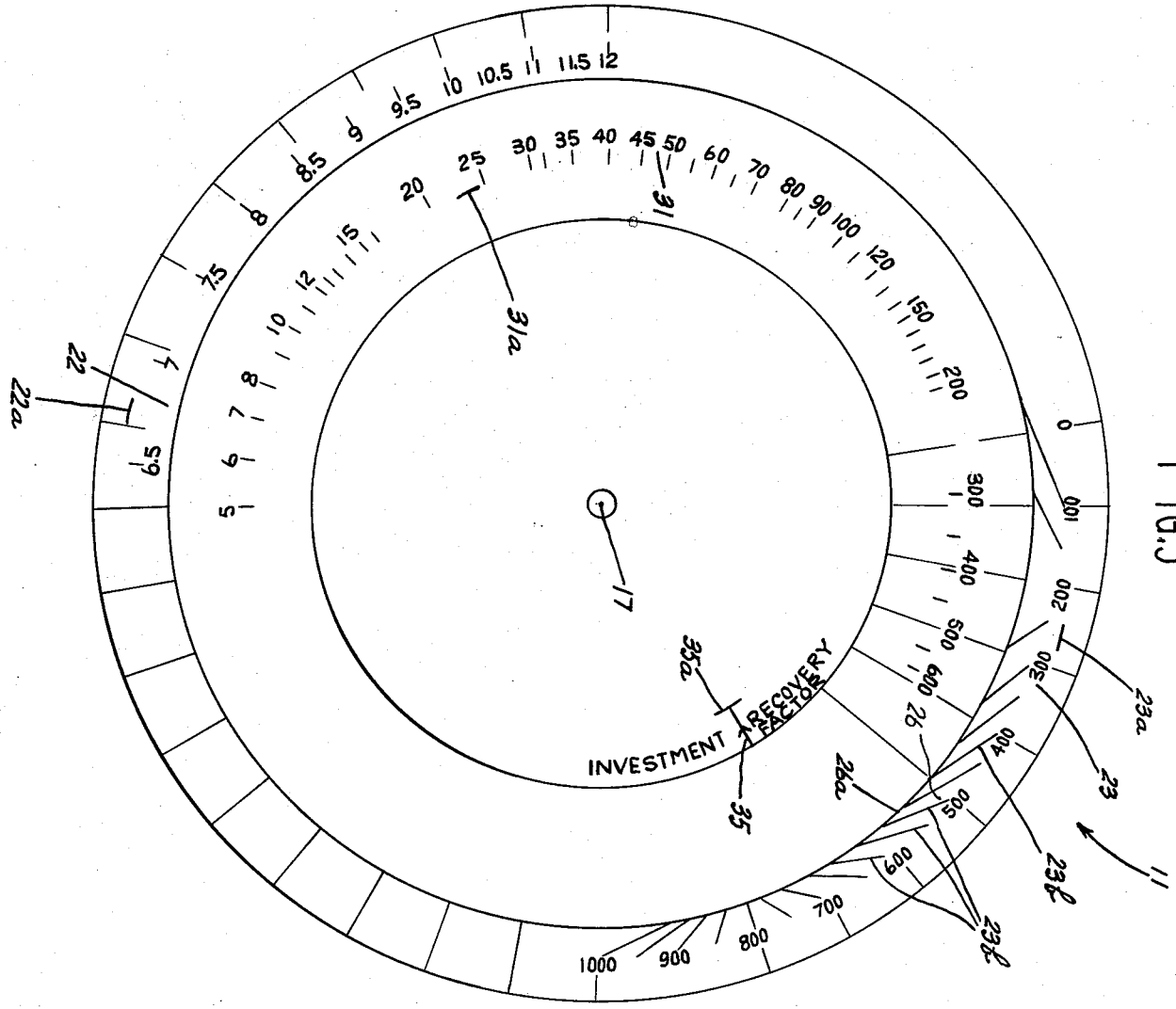
FIG. 3 is a top plan view of a first, lowermost, disc of the calculator in FIG. 1.
Figure 6:
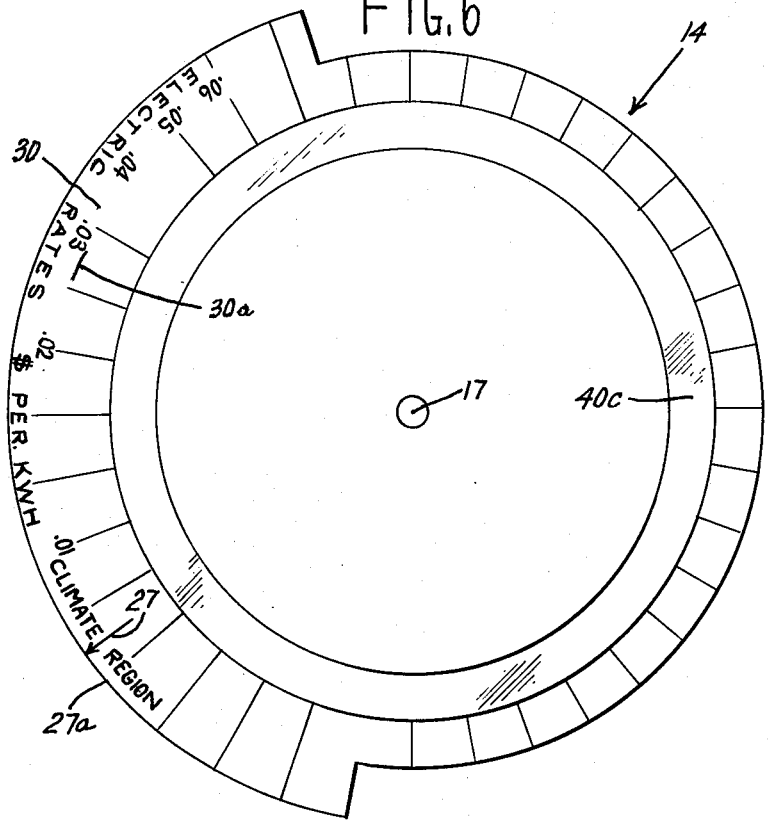
FIG. 6 is a top plan view of a fourth disc of the calculator shown in FIG. 1.
Figure 8:
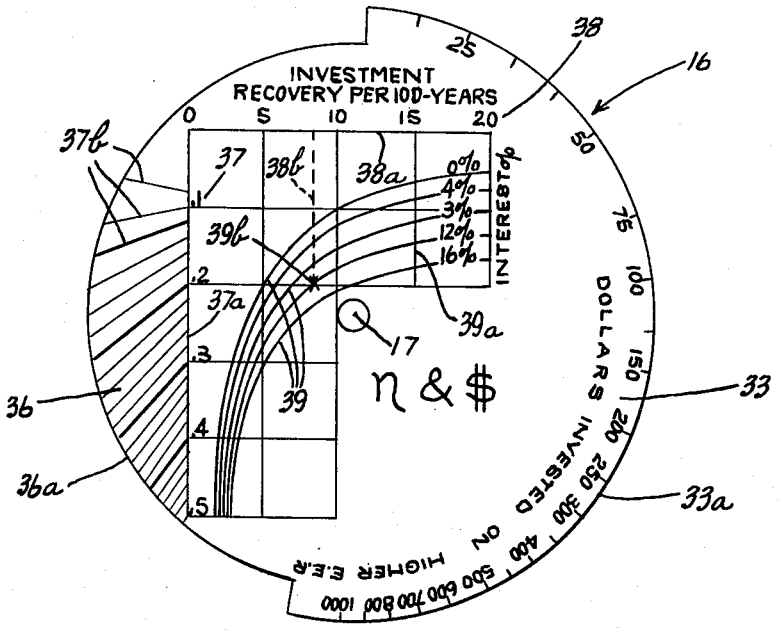
FIG. 8 is a top plan view of the sixth disc shown in the calculator of FIG. 1.
Figure 7:
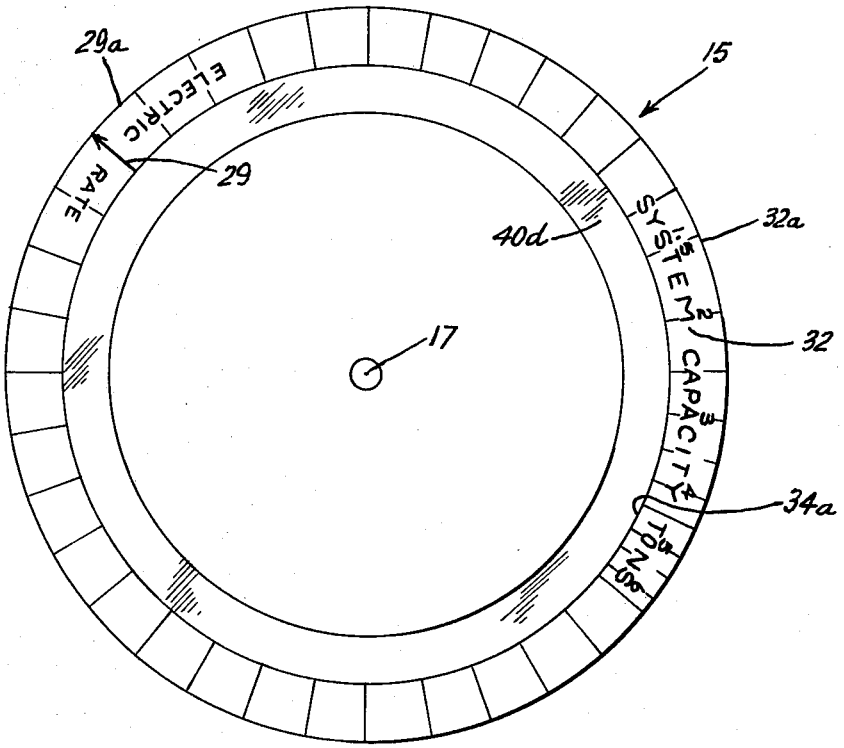
FIG. 7 is a top plan view of the fifth disc of the calculator shown in FIG. 1.

Referring to the drawings, calculator 10 has six discs, 11, 12, 13, 14, 15, and 16, concentrically mounted for relative rotation about axis 17. The lowermost disc 11 is shown in FIG. 3; disc 12, FIG. 4, is placed next above disc 11; disc 13, FIG. 5, is placed next above disc 12; disc 14, FIG. 6, is placed next above disc 13; disc 15, FIG. 7, is placed next above disc 14; and disc 16, FIG. 8, the uppermost disc is placed next above disc 15.

As will become apparent in the following description, the calculator 10 is used to determine that period of time, in years, in which the added expenditure required to purchase a high efficiency air conditioner over a lower efficiency air conditioner can be recovered, taking into account the relative efficiencies of the air conditioners, the capacity in "tons" of the air conditioners; the climatic region in which the air conditioner is to be used; the electric utility rate of the region in which the air conditioner is to be used; and the financing costs available in the region in which the air conditioner is purchased. The construction of the calculator, the scales and indices on the disc, and the manner in which the above variables are used in the calculation will now be described.

Figure 4:
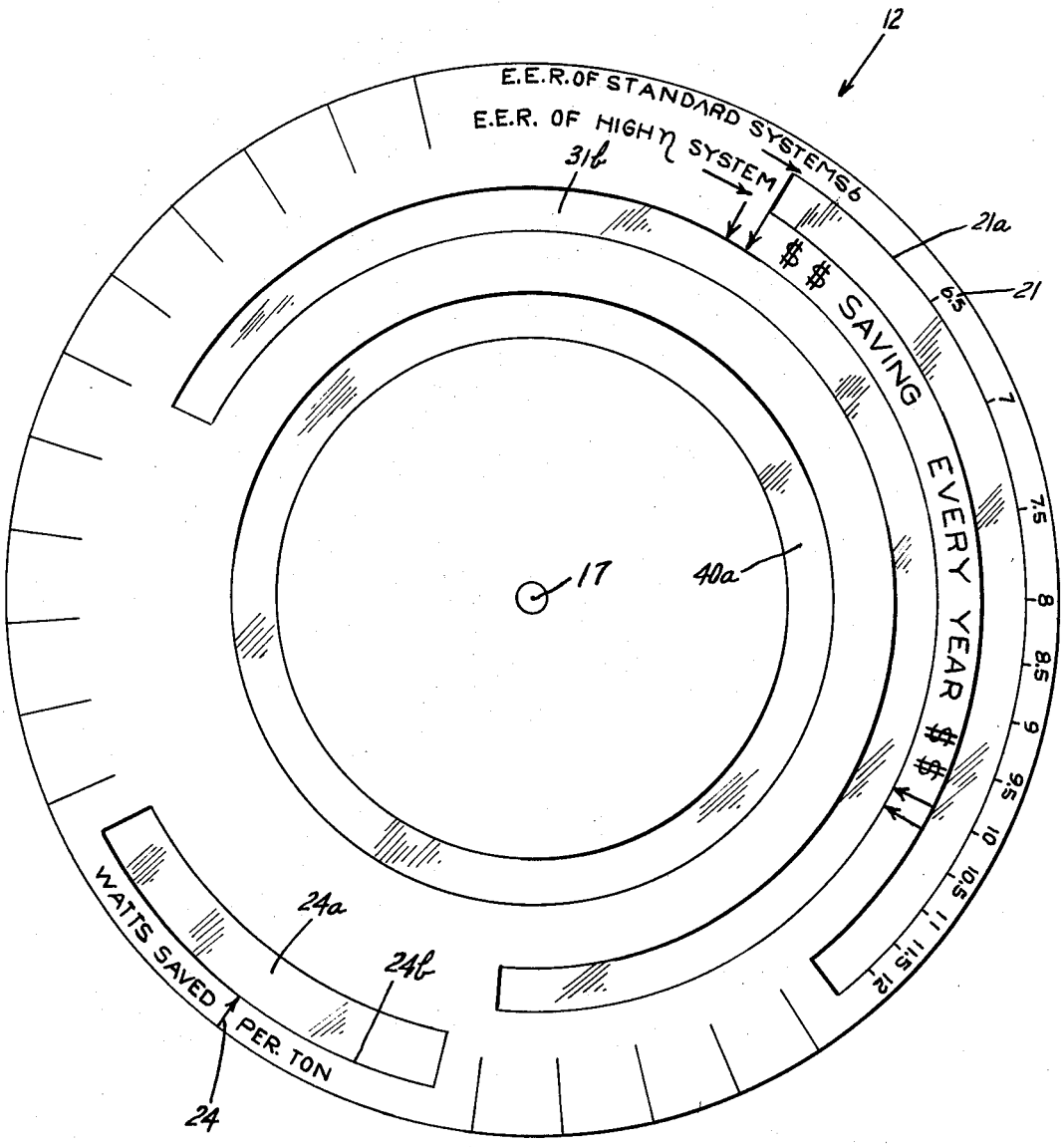
FIG. 4 is a top plan view of a second disc of the calculator of FIG. 1.
Figure 5:
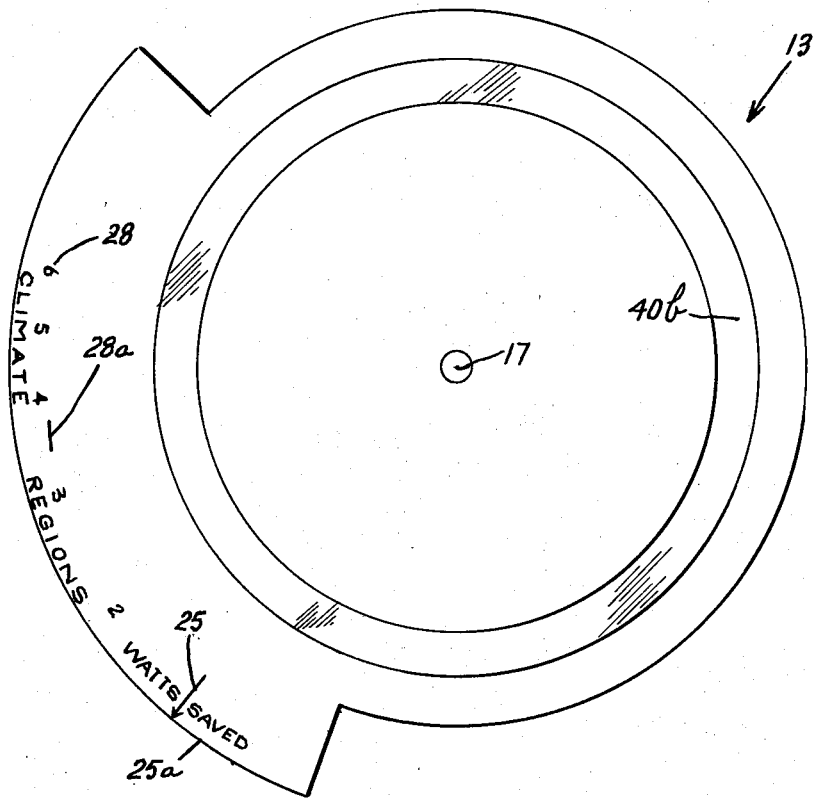
FIG. 5 is a third disc of the calculator shown in FIG. 1.

A first scale 21 graduated in units of energy efficiency ratio (E.E.R.) of a standard system for air conditioner is at an outer radial position of disc 12, FIG. 4, and is read on arc 21*a* concentric with axis 17. Disc 11, FIG. 3, has a second scale 22 at an outer radial position which is graduated in units of energy efficiency ratio (E.E.R.) of the higher efficiency air conditioner which may be read along concentric arc 22*a*. Arc 22*a* is registrable with arc 21*a*. A third scale 23 graduated in units of watts saved per ton is at an outer radial position of disc 11 and is read on concentric arc 23*a*. Each unit in scale 23 is connected by a line 23*b* which terminates at a fourth scale 26 and is read on concentric arc 26*a* of disc 11. A first index 24 labeled "Watts Saved per Ton" is located at the outer circumference of disc 12 approximately centrally of a window 24*a* and is alignable at concentric arc 24*b* with scale graduations, later described. A second index 25 labeled "Watts Saved" is on disc 13, FIG. 5, and is alignable at concentric arc 25*a* with fourth scale graduations, which are at the inner ends of lines 23*b* and appear at arc 26*a*. A third index 27 is at an outer radial position of disc 14, FIG. 6, and is labeled "Climate Region" alignable at concentric arc 27*a* with scale graduations, later described. A fifth scale 28 is graduated in units of Climate Region, determined from the region designations in FIG. 2, and is at an outer radial position of disc 13 and is read at concentric arc 28*a* opposite index 27 on disc 14.

A fourth index 29, labeled "Electric Rate", is at an outer radial position of disc 15, FIG. 7, and is alignable at concentric arc 29*a* with a scale, later described. A sixth scale 30, graduated in units of electric rate dollars per kilowatt hour (KWH) is at an outer position of disc 14 and is read at concentric arc 30*a* of disc 14. Arc 30*a* is registrable with arc 29*a* of disc 15 so that index 29 is alignable with the graduated units of scale 30. A seventh scale 31 is at an intermediate radial position on disc 11 and is graduated in units of dollar saving every year and is read along concentric arc 31*a* through window 31*b* of disc 12. An eighth scale 32 graduated in units of system capacity is at an outer radial position on disc 15 and is read on concentric arc 32*a*. Arc 32*a* is registrable with arc 31*a*.

A ninth scale 33 graduated in units of dollars invested on higher E.E.R. air conditioner, is at an outer radial position on disc 16 and is read on concentric arc 33*a*. Scale 32 also may be read on concentric arc 34*a* on disc 15 which is registrable with arc 33*a* on disc 16. A fifth index 35 is at an intermediate radial position on disc 11 and is alignable with a scale 36, next described at concentric arc 35*a* on disc 11. An eleventh scale 36 graduated in units of investment recovery factor is located at an outer radial position of disc 16 and is read at concentric arc 36*a* on disc 16. Arc 36*a* on disc 16 is registrable with arc 35*a* on disc 11 so that index 35 is alignable with the graduated units of scale 36.

A twelfth scale 36 also graduated in units of investment recovery factor and is located along chordal line 37*a* on disc 16 and is connected by lines 37*b* to coresponding graduated units on scale 36. A thirteenth scale 38 graduated in units of investment recovery period-years is read at chordal line 38*a* orthogonally related to chordal line 37*a*, on disc 16. A plurality of nonlinear lines 39 are drawn on disc 36 within the included area of scales 37*a* and 38*a*, with each line 39 representing a financing interest charge with the topmost line being zero percent, and the succeeding lines 39 being labeled 4%, 8%, 12% and 16%, which correspond to the various financing rates. The interest rates shown in curves 39 are based on a compounded yearly rate.

Annular windows 40*a*, 40*b*, 40*c* and 40*d* are formed respectively in discs 12, 13, 14 and 15 to permit visible registration between scale 35*a* on disc 11 and 36*a* on disc 16.

In the operation of the embodiment shown in the drawings, the energy efficient ratio (E.E.R.) of a standard system or air conditioner on scale 21 is aligned with the E.E.R. of the higher efficiency system on scale 22. The watts saved per ton is then read on scale 23, disc 11, opposite index 24, disc 12. Then the index 25 is aligned with the line 23*b* which intersects arc 26*a* and which line 23*b* is aligned with index 24 at arc 23*a*. Thus, if index 24 is at 400, the line 23*b* leading from the graduation 400 at arc 23*a* is followed until it intersects arc 26*a* and index 25 is aligned at the intersection of that line 23*b* and arc 26*a*.

Figure 1:
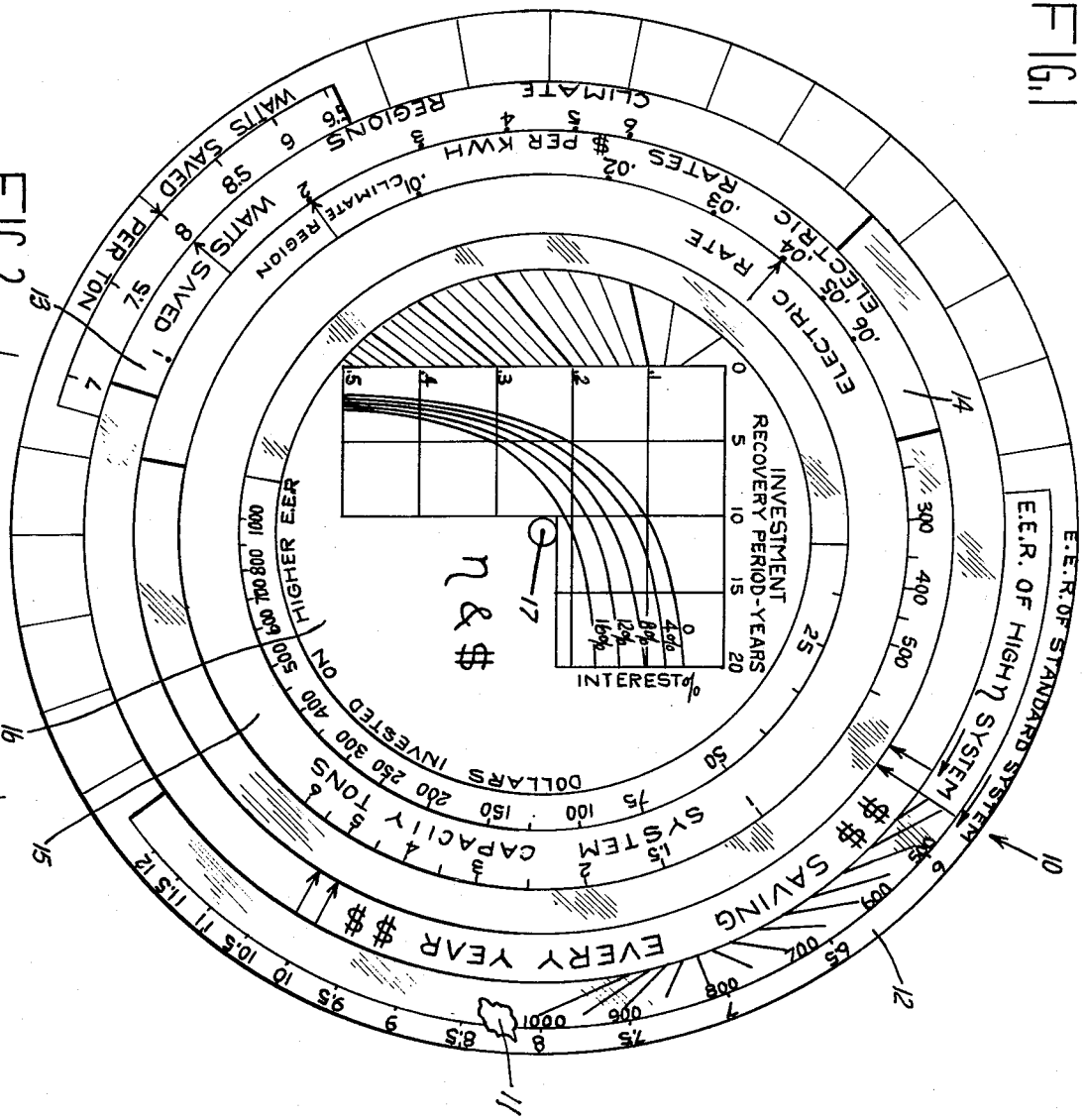
FIG. 1 is a top plan view of an assembled calculator having six discs concentrically mounted for relative rotation.
Figure 2:
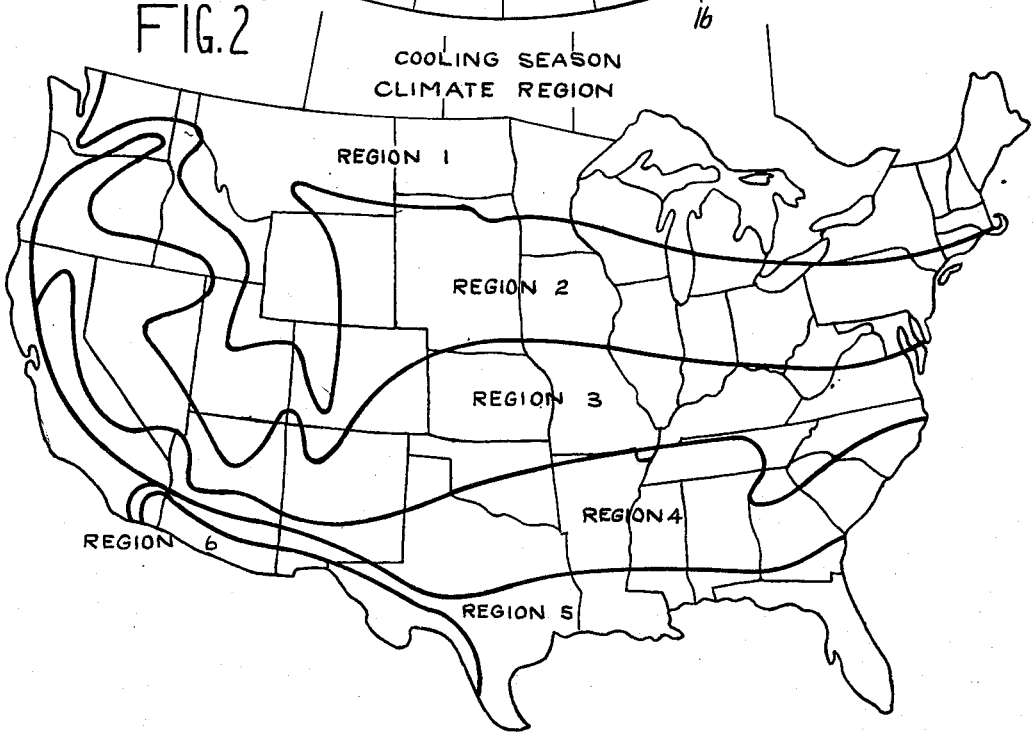
FIG. 2 is a geographic map having climatic regions indicated thereon, which map may be placed on the reverse side of the lowermost disc shown in FIG. 3.

The climate region is selected from the graph of FIG. 2 and assuming that the region of anticipated use for the air conditioner falls within region 2 as defined on the map in FIG. 2, index 27 on disc 14 is aligned with the numeral 2 on scale 28 on disc 13. Next, the index 29 on disc 15 is aligned with the graduation on scale 30 on disc 14 which corresponds to the electric rate in the community in which the air conditioner is to be used. Then, the dollar savings every year can be read on scale 31 on disc 11 opposite the graduation unit on scale 32 of disc 15 corresponding to the capacity of the air conditioner as rated in tons. In the next step of the computation, the additional expenditure in dollars of the higher efficiency air conditioner over the standard air conditioner is selected on scale 33 on disc 16 and the graduation corresponding to this expenditure is aligned with the graduation corresponding to system capacity on scale 32 at arc 34*a* on disc 15. The investment recovery factor is then read on scale 36 at arc 36*a* on scale 16 opposite index 35 on disc 11. Once the investment recovery factor has been determined, the corresponding line 37*b* which intersects arc 36*a* is then followed to the intersection of that line 37*b* with scale 37 at line 37*a*. The financing interest rate for the community in which the air conditioner is purchased is then selected at the appropriate line 39 on disc 16. For example, assuming that the financing interest rate is 12%, the line 39 corresponding to 12% at scale 39*a* is selected and assuming that the investment recovery factor is 0.2, the horizontal line with the graduation 0.2 on scale 37*a* is followed rightwardly unitl it intersects the line 39 corresponding to 12% which occurs at point 39*b* on disc 16. Then, a vertical line 38*b* is drawn upwardly until it intersects scale 38*a*, intersecting scale 38*a* at approximately 9 indicating that it would take 9 years of air conditioner use in order to recover the initial additional investment expenditure in buying the more expensive, higher efficiency air conditioner over the standard air conditioner. This can then be compared against the life expectancy of the air conditioner, and other factors personal to the situation of the purchaser to aid the purchaser in determining the advisability of buying the higher efficiency unit.

While there have been described above the principles of this invention in connection with specific apparatus, it is to be understood that this description is made only by way of example and not as a limitation to the scope of the invention.

What is claimed is:

1. A calculator for computing the investment recovery period for investment expenditure of a first product over a second product comprising:

first, second, third, fourth, fifth and sixth members concentrically mounted for rotation relative one another;

a first scale graduated according to the efficiency of the second product being on said second member;

a second scale graduated according to the efficiency of the first product being on said first member and being registrable with said first scale;

a third scale graduated in power saved per unit of product capacity of the product being on the first member;

a first index for indicating power saved per unit of product capacity being on the second member and registrable with said third scale;

a fourth scale related in a predetermined manner to said third scale and graduated in power saved being on said first member;

a second index indicating power saved being on said third member and registrable with said fourth scale;

a fifth scale graduated in climate regions being on said third member;

a third index indicating climate region being on said fourth member and resistrable with said fifth scale;

a sixth scale graduated in power rates being on said fourth member;

a fourth index indicating power rates being on said fifth member and registrable with said sixth scale;

a seventh scale indicating financial savings each year being on said first member;

an eighth scale being graduated in product capacity being on said fifth member and registrable with said seventh scale;

a ninth scale being graduated in financial cost of said first product over said second product being on said sixth member;

a tenth scale being related to said eighth scale and indicating product capacity being on said fifth member and registrable with said ninth scale;

an eleventh scale being graduated in investment recovery factor units being on said sixth member;

a fifth index indicating investment recovery factor being on said first member and registrable with said eleventh scale;

a twelfth scale related to said eleventh scale and graduated in investment recovery factor units being on said sixth member;

a thirteenth scale relating to investment recovery period and related to said eleventh scale being on said sixth member;

a plurality of non-linear curves relating to financial interest rates being related to said twelfth and thirteenth scales being on said sixth member and being visible to convert from said investment recovery factor units to said investment recovery period units.

2. The apparatus of claim 1 having windows being in said second member whereby said second index is visually alignable with said fourth scale;

a window being in said second member; said third and fourth members having portions removed therefrom whereby said seventh and eighth scales are visually alignable;

windows being in said second, third, fourth and fifth members whereby said fifth index is visually alignable with said eleventh scale.

3. The apparatus of claim 1 wherein said first product is an air conditioner of higher efficiency and said second product is an air conditioner of standard efficiency;

said power saved per unit of product capacity is in units of watts saved per ton;

said power saved is in units of watts saved;

said climate region is in one of a plurality of regions in the United States arranged and selected according to similar climatic conditions;

said financial cost of said first product over said second product is in units of dollars invested on the higher efficiency air conditioner over the cost of the standard air conditioner; and the investment recovery period is in units of years.

* * * * *